US007654611B1

(12) United States Patent
Kesrouani

(10) Patent No.: US 7,654,611 B1
(45) Date of Patent: Feb. 2, 2010

(54) COLLAPSIBLE SEAT

(76) Inventor: Roy Elias Kesrouani, 1404 Oak Grove Dr., Los Angeles, CA (US) 90041

( * ) Notice: Subject to any disclaimer, the term of this patent is extended or adjusted under 35 U.S.C. 154(b) by 0 days.

(21) Appl. No.: 12/362,502

(22) Filed: Jan. 30, 2009

(51) Int. Cl.
*A47C 4/28* (2006.01)

(52) U.S. Cl. ..... 297/45

(58) Field of Classification Search ..... 297/16.1, 297/45, 42
See application file for complete search history.

(56) References Cited

U.S. PATENT DOCUMENTS 2,689,602 A * 9/1954 Morgan ..... 297/45
3,124,387 A * 3/1964 MaClaren ..... 297/16.2
4,807,930 A * 2/1989 Helfrich ..... 297/16.2
5,979,976 A 11/1999 Ferencik
7,048,331 B2 * 5/2006 Saakyan ..... 297/16.1
2007/0012348 A1 1/2007 Hoberman

* cited by examiner

*Primary Examiner*—Milton Nelson, Jr.
(74) *Attorney, Agent, or Firm*—Ash Tankha

(57) ABSTRACT

Disclosed herein is a collapsible seat and a method of providing a seating area in a folded arrangement and an unfolded arrangement. The collapsible seat comprises a seating section, a base section, and a pair of collapsible legs. The seating section comprises a seat base, a lumbar support, and arm rests defined by first planar sections. The base section comprises lateral supports and a resting base defined by second planar sections to support the seating section. The lateral supports are pivotally connected to the seating section. The pair of collapsible legs is defined by a pair of third planar sections to support the seating section. The collapsible legs are pivotally connected to lateral edges of the lumbar support of the seating section. Each of the first planar sections, the second planar sections, and the third planar sections is a polygon of a substantially similar shape and size to each other.

13 Claims, 22 Drawing Sheets

COLLAPSIBLE SEAT

BACKGROUND

This invention, in general, relates to a seat. More particularly, this invention relates to a collapsible seat that provides a seating area in a folded arrangement and an unfolded arrangement.

Typically, foldable seats are used to provide readily available seating areas. When not in use, the foldable seats may be folded and stored. However, the foldable seats may not provide a seating area in the folded arrangement.

Typically, a foldable seat comprises different parts, for example, the seat, the lumbar support, etc. If any one of the parts is damaged, the entire foldable seat may need to be replaced. Even if the damaged part can be replaced, each damaged part must be replaced by a similar part. The different parts of the seat are not interchangeable. Also, different parts of the foldable seat, when dismantled may occupy a large amount of storage space.

Foldable seats may be formed using parts, for example, annular rings. However, the foldable seats formed using the annular rings do not have arm rests and therefore may not be comfortable to sit on. The foldable seats may not have legs and weight supports, and therefore may be unstable and may lack structural strength. Furthermore, the foldable seat formed using the annular rings provides a seating area only in the unfolded arrangement.

Hence, there is an unmet need for a constructing a collapsible seat using parts of a substantially similar shape and size in a specific configuration that provides a seating area in a folded arrangement and an unfolded arrangement. Furthermore, there is a need for a collapsible seat with easily replaceable interchangeable parts.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The collapsible seat and method disclosed herein addresses the above stated for providing a seating area in the folded arrangement and unfolded arrangement of the collapsible seat. The collapsible seat disclosed herein has easily replaceable interchangeable parts, thereby enabling easy replacement of damaged parts of the collapsible seat.

The collapsible seat comprises a seating section, a base section, and a pair of collapsible legs. The seating section comprises a seat base, a lumbar support, and a pair of arm rests. Each of the seat base, the lumbar support, and the pair of arm rests is defined by one of multiple first planar sections. Each of the first planar sections is a polygon of a substantially similar shape and size to each other of the first planar sections. Each of the first planar sections defines at least three edges on a periphery of each of the first planar sections. At least two of the edges of each of the first planar sections define a first vertex. One of the edges of each of the first planar sections is attached to one of the edges of an adjacent one of the first planar sections. The first vertex of each of the first planar sections lies at a first convergence point common to all of the first planar sections.

The base section is pivotally connected to one of at least three edges of the seat base of the seating section. The base section comprises a pair of lateral supports and a resting base.

Each of the pair of lateral supports and the resting base is defined by one of multiple second planar sections for supporting the seating section. Each of the second planar sections is a polygon of a substantially similar shape and size to each other of the second planar sections. Each of the second planar sections defines at least three edges on a periphery of each of the second planar sections. At least two of the edges of each of the second planar sections define a second vertex. One of the edges of each of the second planar sections is attached to one of the edges of an adjacent one of the second planar sections. The second vertex of each of the second planar sections lies at a second convergence point common to all of the second planar sections. The base section comprises a metallic structure attached between endmost vertices defined by upper edges of the pair of lateral supports and further attached to one of at least three edges of the seat base of the seating section for enabling pivoting movement of the seating section.

The pair of collapsible legs is defined by one of a pair of third planar sections. Each of the pair of third planar sections is a polygon of a substantially similar shape and size to each other of the third planar sections. Each of the third planar sections defines at least three edges on a periphery of each of the third planar sections. One of the edges of each of the pair of third sections is pivotally connected to one of the edges of the lumbar support of the seating section for further supporting the seating section. The pair of collapsible legs may comprise multiple weight supports attached to bottom vertices of the pair of third planar sections. The weight supports rest on a flat surface for supporting position of the seating section and bearing weight of the seating section.

The polygon may, for example, be a triangle and each of the first planar sections, the second planar sections, and the third planar sections is of a substantially similar shape and size to each other of the first planar sections, the second planar sections and the third planar sections. The seating section and the base section each define a four-sided pyramid. The collapsible seat may further comprise a hinge at each lateral edge of the lumbar support of the seating section and at the upper edge of each of the pair of collapsible legs. The hinge enables pivoting movement of the pair of collapsible legs. The collapsible seat may further comprise a support structure detachably attached to the base section at the second convergence point for supporting the base section on a flat surface. The collapsible seat may be used for stacking other collapsible seats on top of each other in the folded arrangement.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
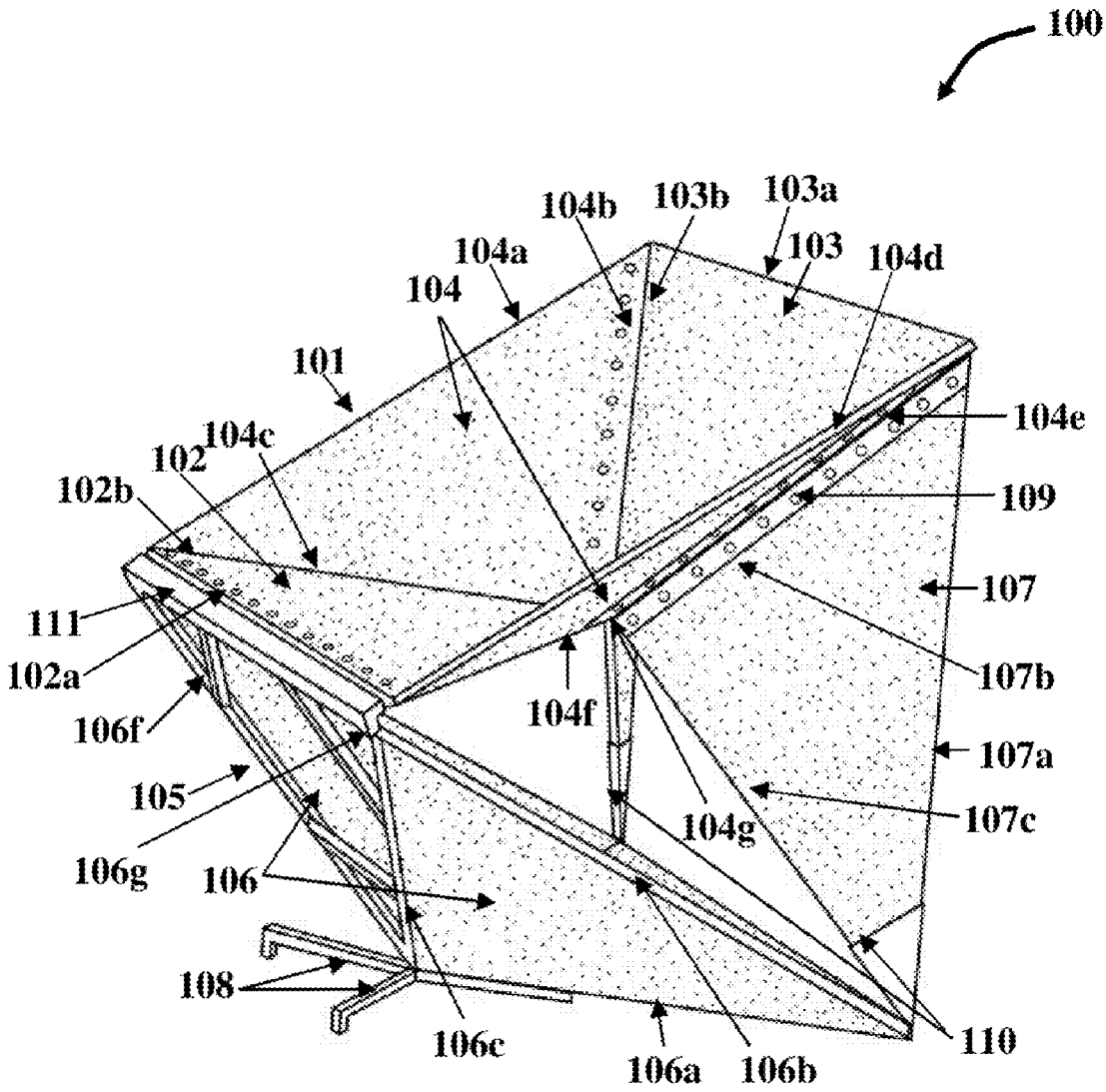
FIG. 1 illustrates a front isometric view of a collapsible seat in an unfolded arrangement.
Figure 2:
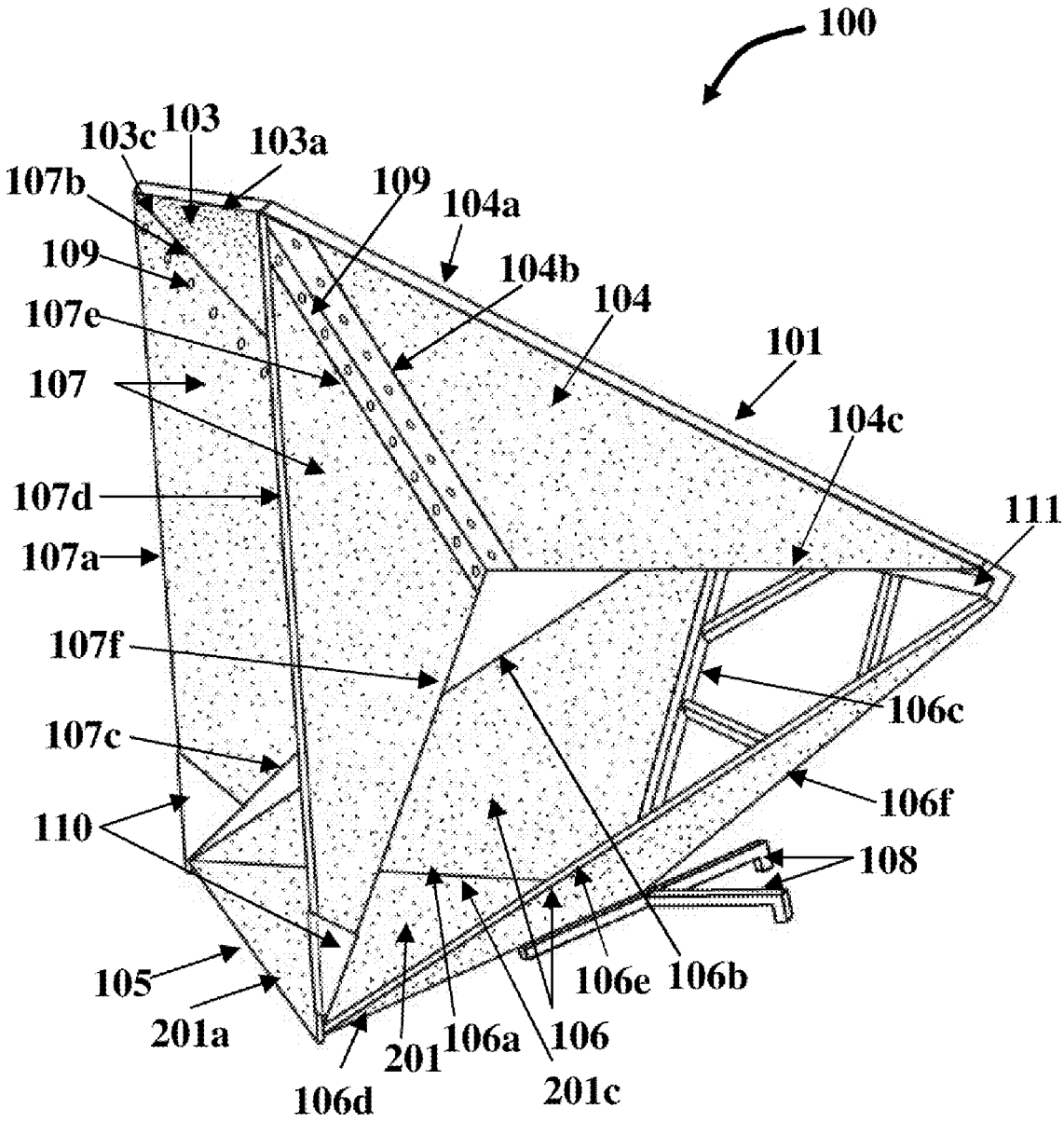
FIG. 2 illustrates a rear isometric view of the collapsible seat in an unfolded arrangement.
Figure 5:
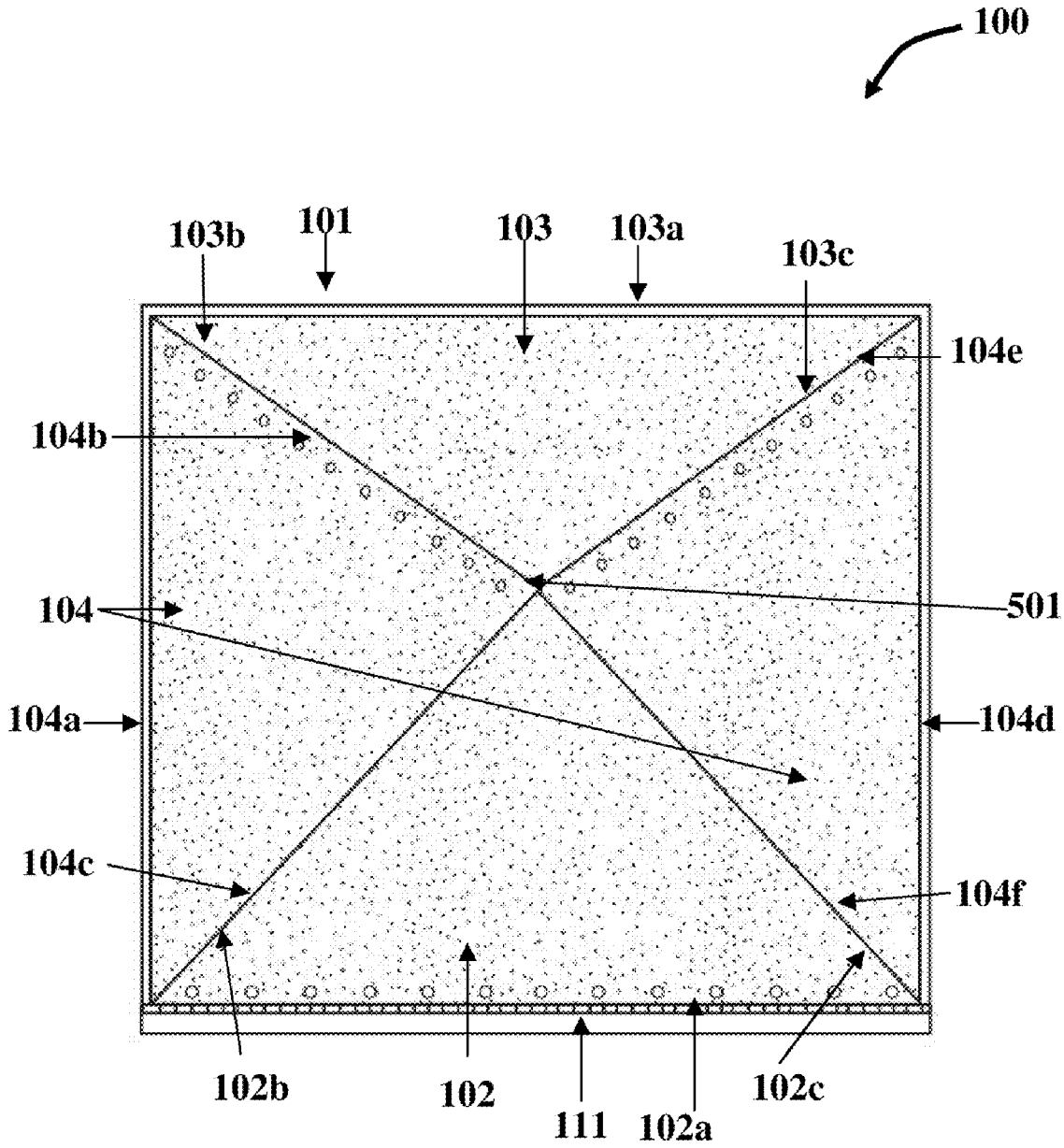
FIG. 5 exemplarily illustrates a top view of the collapsible seat showing the seating section of the collapsible seat in the unfolded arrangement.

FIG. 1 illustrates a front isometric view of a collapsible seat 100 in an unfolded arrangement. The collapsible seat 100 comprises a seating section 101, a base section 105, and a pair of collapsible legs 107. A rear isometric view of the collapsible seat 100 in the unfolded arrangement is illustrated in FIG. 2. The seating section 101 comprises a seat base 102, a lumbar support 103, and a pair of arm rests 104. Each of the seat base 102, the lumbar support 103, and the pair of arm rests 104 is defined by one of multiple first planar sections 102, 103, and 104. Each of the first planar sections 102, 103, and 104 is a polygon of a substantially similar shape and size to each other of the first planar sections 102, 103, and 104. Each of the first planar sections 102, 103, and 104 defines at least three edges 102*a*, 102*b*, 102*c*, and 103*a*, 103*b*, 103*c*, and 104*a*, 104*b*, 104*c*, and 104*d*, 104*e*, 104*f* respectively on a periphery of each of the first planar sections 102, 103, and 104 respectively. At least two of the edges of each of the first planar sections 102, 103, and 104 define a first vertex. For example, in FIG. 1, edges 104*e* and 104*f* of the first planar section 104 define a first vertex 104*g*. One of the edges of each of the first planar sections 102, 103, and 104 is attached to one of the edges of an adjacent one of the first planar sections 102, 103, and 104. For example, in FIG. 1, edge 103*b* of the first planar section 103 is attached to edge 104*b* of the first planar section 104. The first vertex of each of the first planar sections 102, 103, and 104 lies at a first convergence point 501 common to all the first planar sections 102, 103, and 104 as illustrated in FIG. 5.

Figure 7:
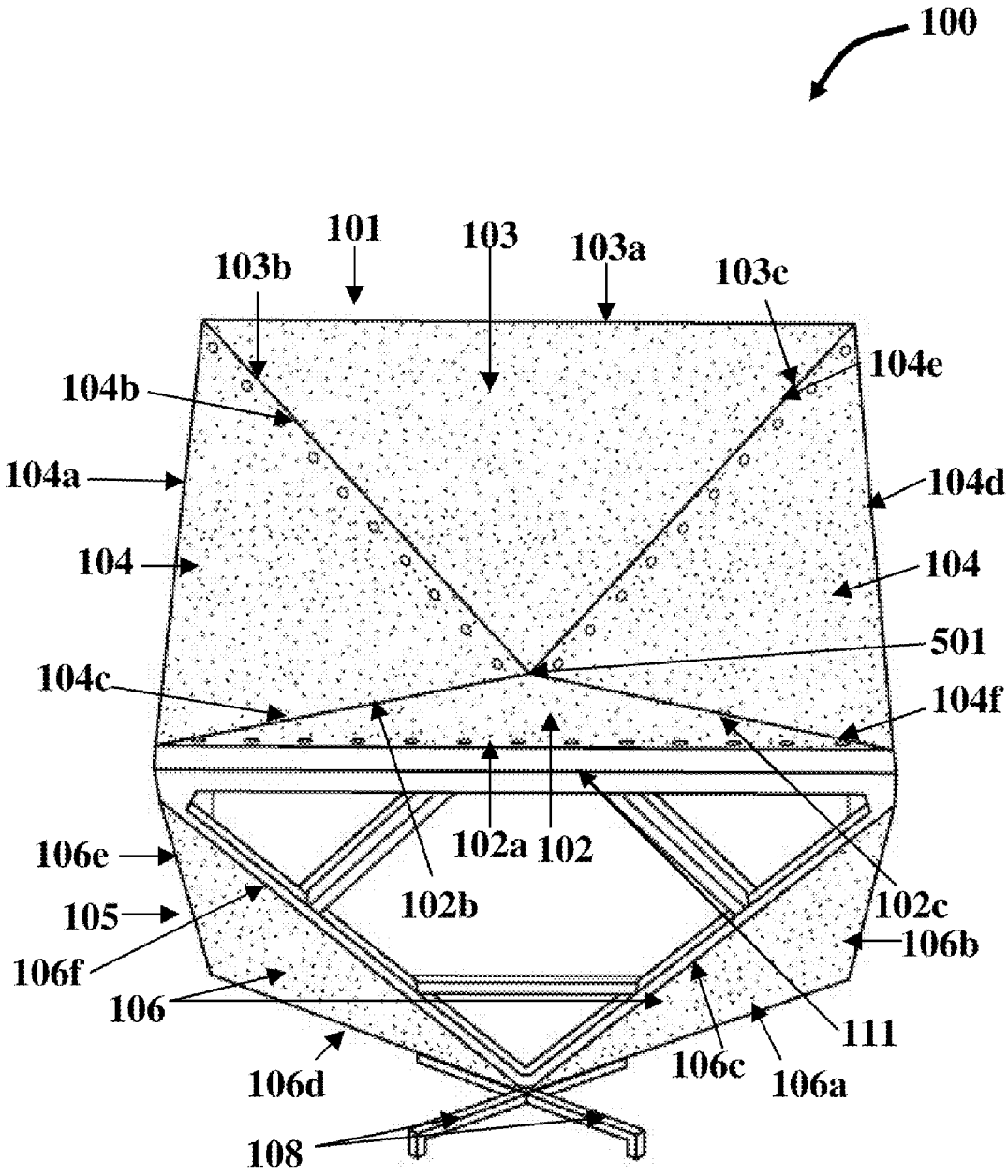
FIG. 7 exemplarily illustrates a front elevation view of the collapsible seat in the unfolded arrangement.

A person may sit on the seat base 102 of the seating section 101. A top view of the collapsible seat 100 showing the seating section 101 of the collapsible seat 100 in an unfolded arrangement is exemplarily illustrated in FIG. 5. The lumbar support 103 of the seating section 101 supports the back of the person. The pair of arm rests 104 supports the arms of the person. A front elevation view of the collapsible seat 100 in the unfolded arrangement is exemplarily illustrated in FIG. 7.

Figure 8:
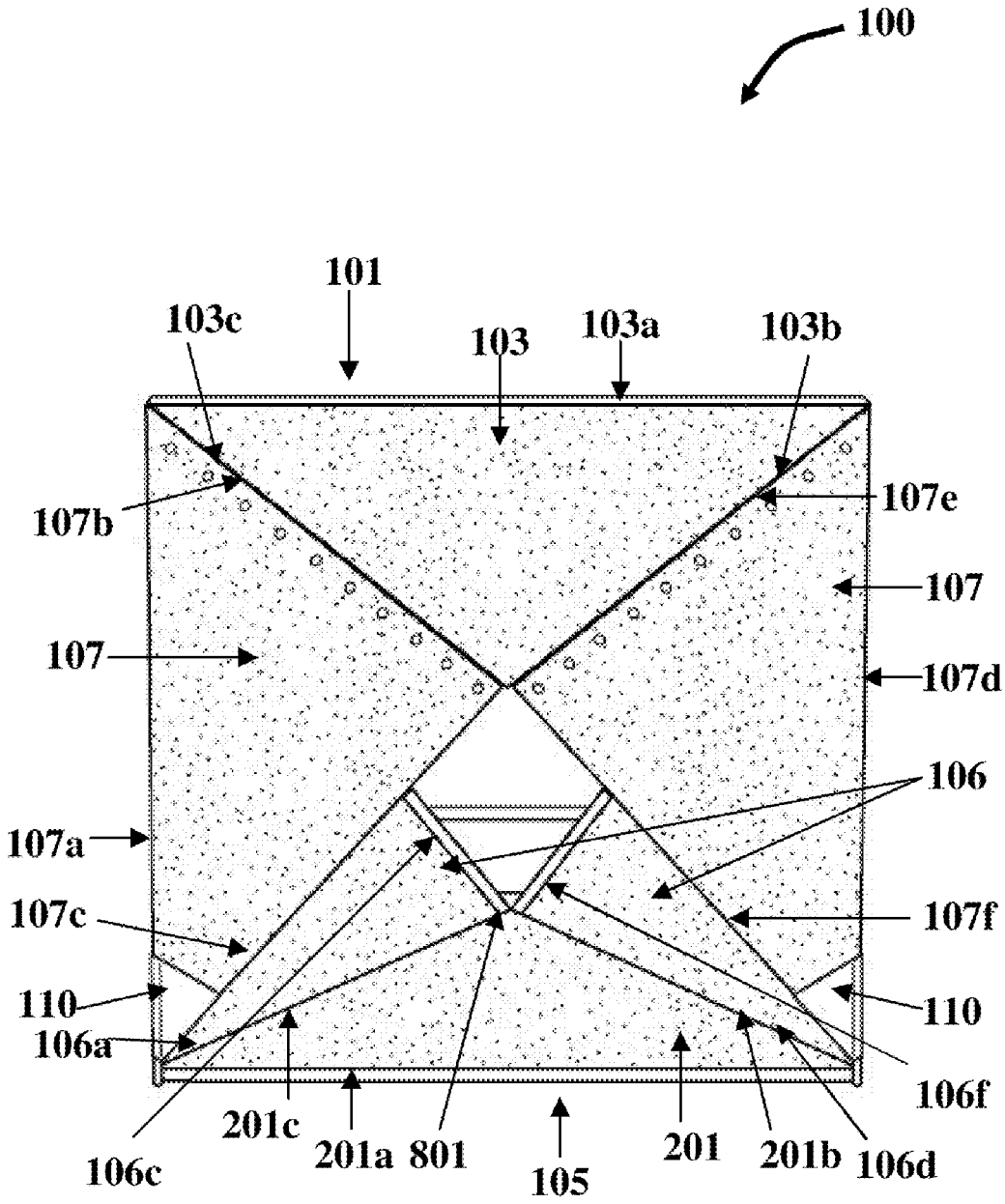
FIG. 8 exemplarily illustrates a rear elevation view of the collapsible seat in the unfolded arrangement.

The base section 105 is pivotally connected to one of at least three edges, for example, edge 102*a* of the seat base 102 of the seating section 101 as exemplarily illustrated in FIG. 1. The base section 105 comprises a pair of lateral supports 106 and a resting base 201. Each of the pair of lateral supports 106 and the resting base 201 is defined by one of multiple second planar sections 106 and 201 for supporting the seating section 101. Each of the second planar sections 106 and 201 is a polygon of a substantially similar shape and size to each other of the second planar sections 106 and 201. Each of the second planar sections 106 and 201 defines at least three edges 106*a*, 106*b*, 106*c*, and 106*d*, 106*e*, 106*f*, and 201*a*, 201*b*, 201*c* respectively on a periphery of each of the second planar sections 106 and 201 respectively. At least two of the edges of each of second planar sections 106 and 201 define a second vertex as illustrated in FIG. 1. For example, in FIG. 1, edges 106*b* and 106*c* of the first planar section 106 define a second vertex 106*g*. One of the edges of each of the second planar sections 106 and 201 is attached to one of the edges of an adjacent one of the second planar sections 106 and 201. For example, in FIG. 2, edge 106*a* of the second planar section 106 is attached to edge 201*c* of the second planar section 201. The second vertex of each of the second planar sections 106 and 201 lies at a second convergence point 801 common to all of the second planar sections 106 and 201 as illustrated in FIG. 8. The base section 105 may further comprise a metallic structure 111 attached between endmost vertices defined by the upper edges 106*b*, 106*c* and 106*e*, 106*f* of the lateral supports 106 and further attached to one of at least three edges, for example, edge 102*a* of the seat base 102 as illustrated in FIG. 1. The metallic structure 111 enables pivoting movement of the seating section 101.

Figure 4:
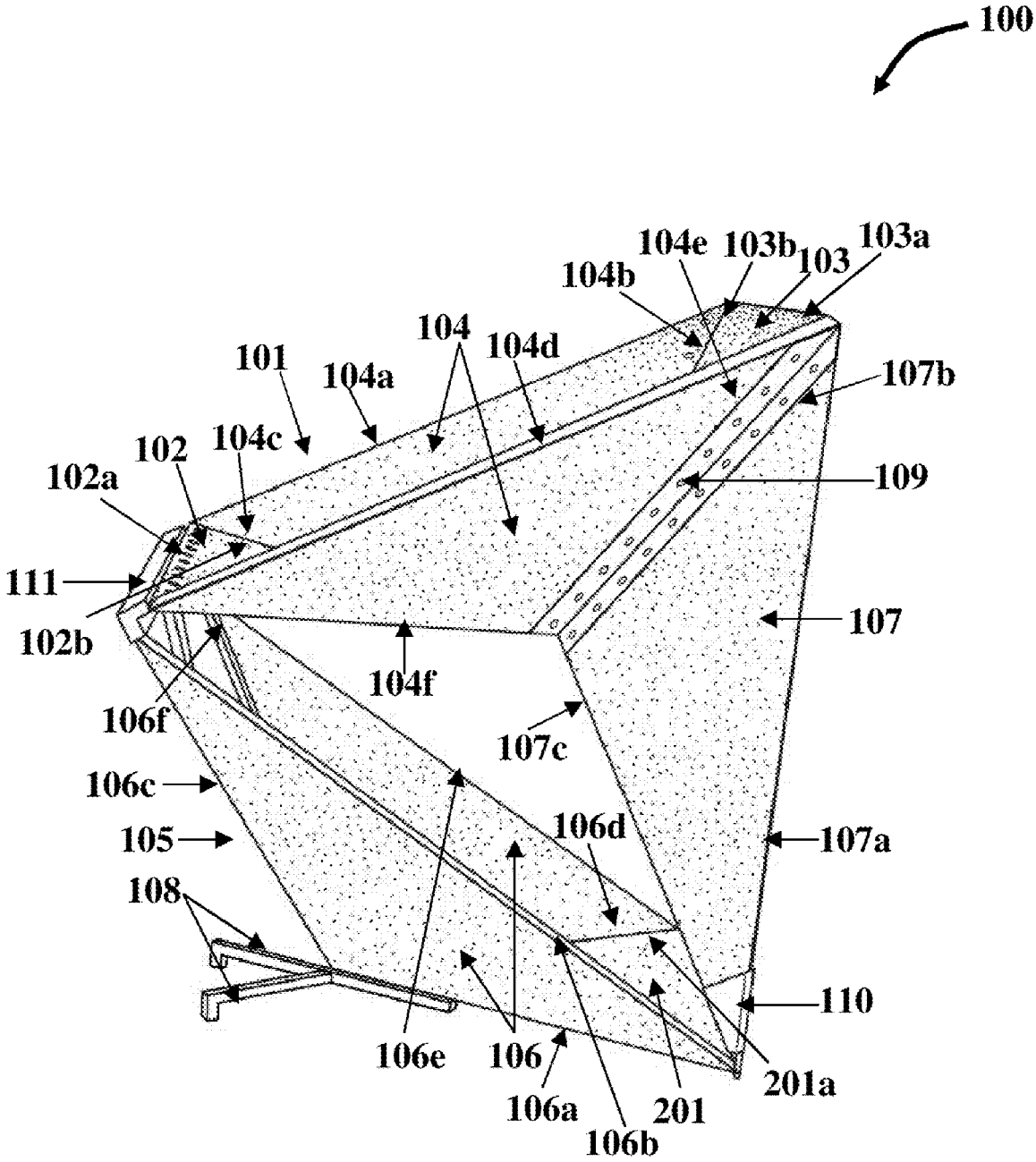
FIG. 4 illustrates a perspective view of the collapsible chair in an unfolded arrangement.

Each of the pair of collapsible legs 107 is defined by one of a pair of third planar sections 107. Each of the pair of third planar sections 107 is a polygon of a substantially similar shape and size to each other of the third planar sections 107. Each of the third planar sections 107 defines at least three edges 107*a*, 107*b*, 107*c*, and 107*d*, 107*e*, 107*f* on a periphery of the third planar sections 107 as illustrated in FIG. 1 and FIG. 2. One of the edges, for example, edge 107*b* and edge 107*e* of each of the third planar sections 107 respectively is pivotally connected to one of the edges, for example, edge 103*c* and edge 103*b* respectively of the lumbar support 103 of the seating section 101 for further supporting the seating section 101 in an unfolded arrangement. A perspective view of the collapsible chair in the unfolded arrangement is exemplarily illustrated in FIG. 4.

Figure 3:
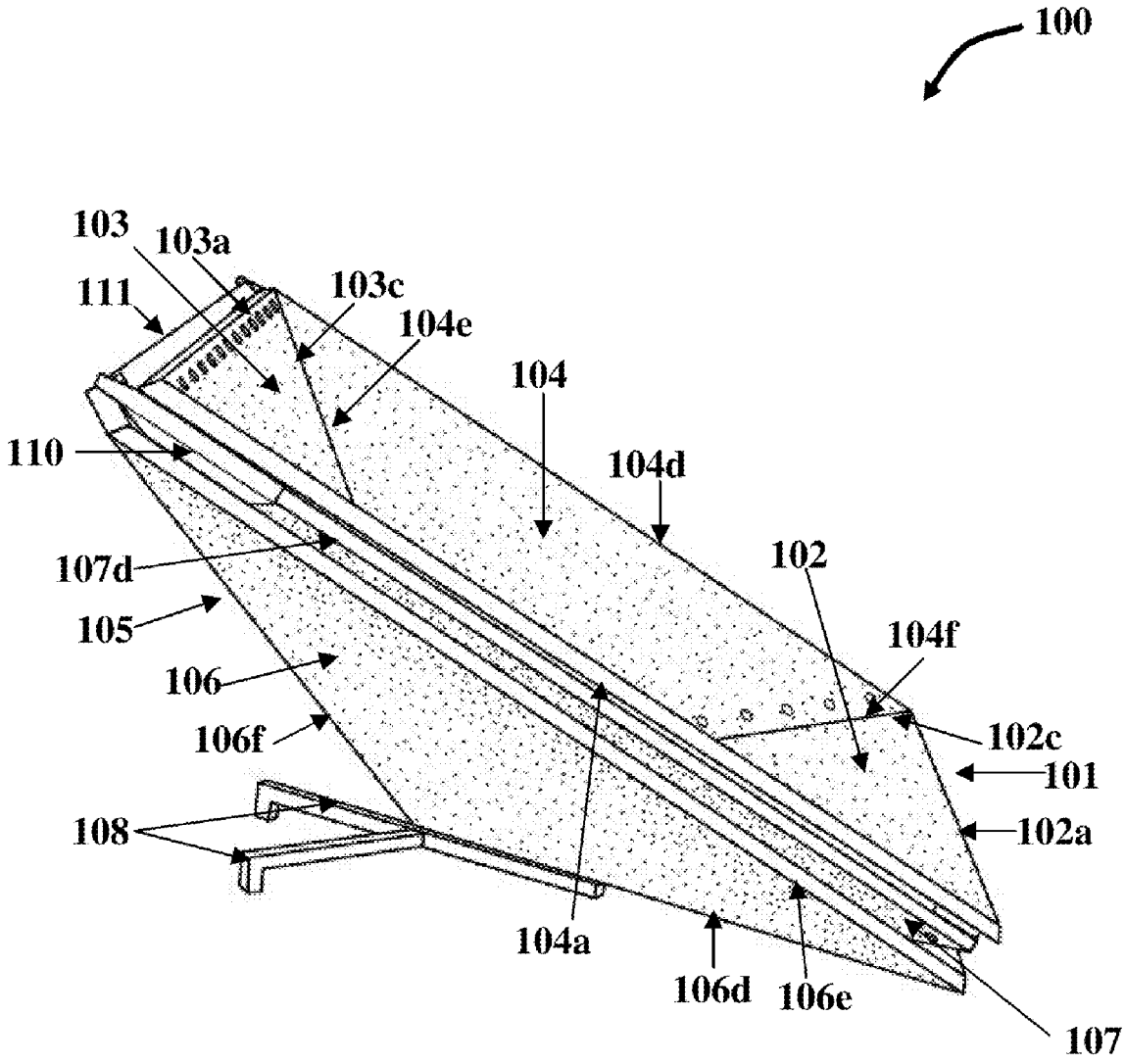
FIG. 3 exemplarily illustrates a perspective view of the collapsible seat in a folded arrangement.
Figure 6:
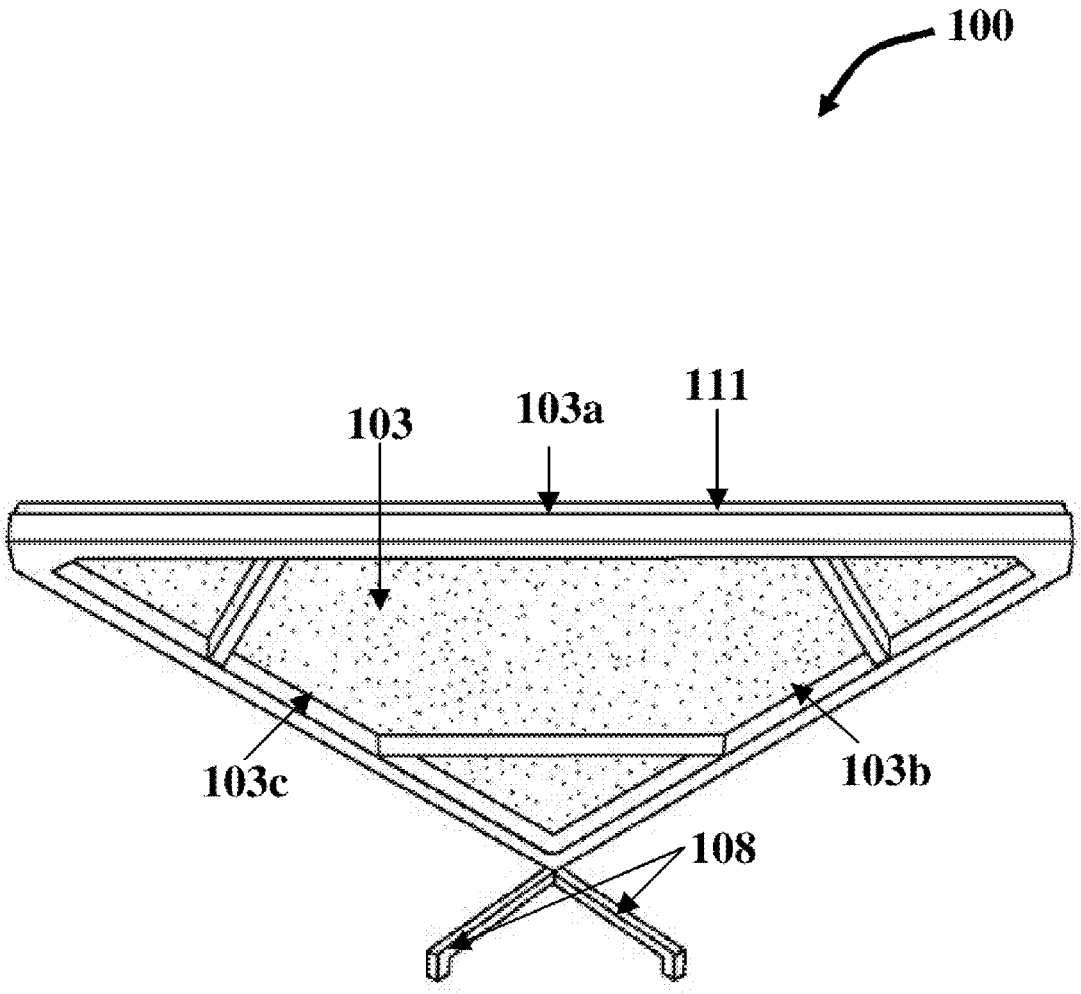
FIG. 6 exemplarily illustrates a top view of the collapsible seat in the folded arrangement.

A hinge 109 may be provided at each lateral edge 103*b* and 103*c* of the lumbar support 103 of the seating section 101 and at upper edge 107*b* and 107*e* of each of the pair of collapsible legs 107. The hinge 109 enables pivoting movement of the pair of collapsible legs 107 for folding the pair of collapsible legs 107 in a folded arrangement. A perspective view of the collapsible seat 100 in a folded arrangement is exemplarily illustrated in FIG. 3. A top view of the collapsible seat 100 in the folded arrangement is exemplarily illustrated in FIG. 6. The pair of collapsible legs 107 may comprise multiple weight supports 110 attached to the bottom vertices of the pair of third planar sections 107. The weight supports 110 rest on a flat surface. The weight supports 110 support the position of the seating section 101 and bear the weight of the seating section 101. A rear elevation view of the collapsible seat 100 in the unfolded arrangement is exemplarily illustrated in FIG. 8.

The polygon may, for example, be a triangle and each of the first planar sections 102, 103 and 104, the second planar sections 106 and 201, and the third planar sections 107 is of a substantially similar shape and size to each other of the first planar sections 102, 103, and 104, the second planar sections 106 and 201, and the third planar sections 107. The seating section 101 and the base section 105 each define a four-sided pyramid. The collapsible seat 100 may further comprise a support structure 108 detachably attached to the base section 105 at the second convergence point 801 for supporting the base section 105 on a flat surface.

For purposes of illustration, the detailed description refers to first planar sections 102, 103, and 104, second planar sections 106 and 201, and third planar sections 107 of the collapsible seat 100. However, the scope of the collapsible seat 100 disclosed herein is not limited to the first planar sections 102, 103, and 104, the second planar sections 106 and 201 and the third planar sections 107 but may be extended to include any number of planar sections.

The first planar sections 102, 103, and 104, the second planar sections 106 and 201, and the third planar sections 107 are polygons of a predefined shape, for example, a triangle. Each of the polygons defines edges on the periphery of the polygon. At least one edge of each polygon is attached to an edge of another polygon. All of the polygons defining the first planar sections 102, 103, and 104, the second planar sections 106 and 201 and the third planar sections 107 are of substantially the same shape and substantially the same size. Where the polygons are triangular, the seating section 101 and the base section 105 each define an inverted four-sided pyramid. The first planar sections 102, 103, and 104, the second planar sections 106 and 201, and the third planar sections 107 may, for example, be made of wood, plastic, metal, etc.

Figure 9:
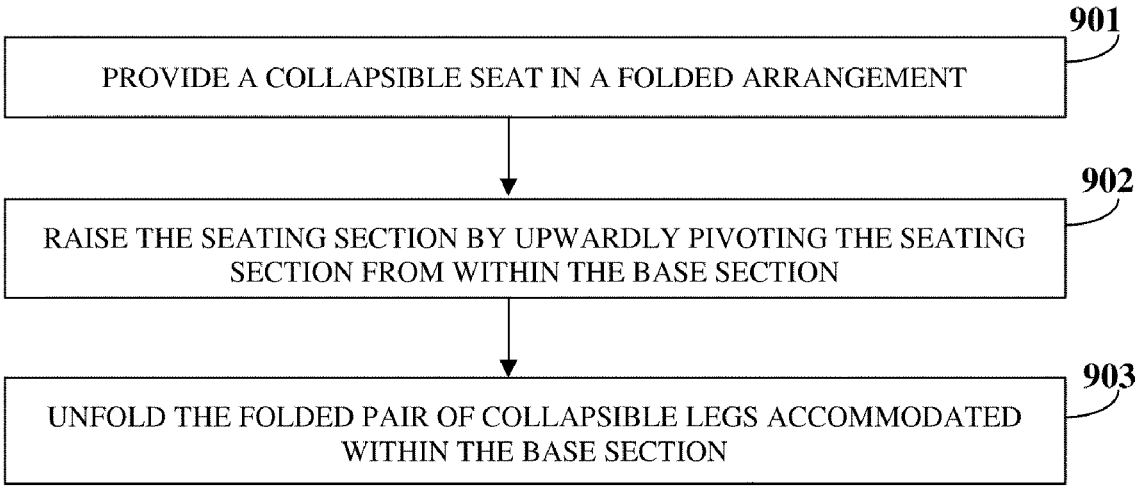
FIG. 9 illustrates a method of providing a seating area in an unfolded arrangement.
Figure 10A:
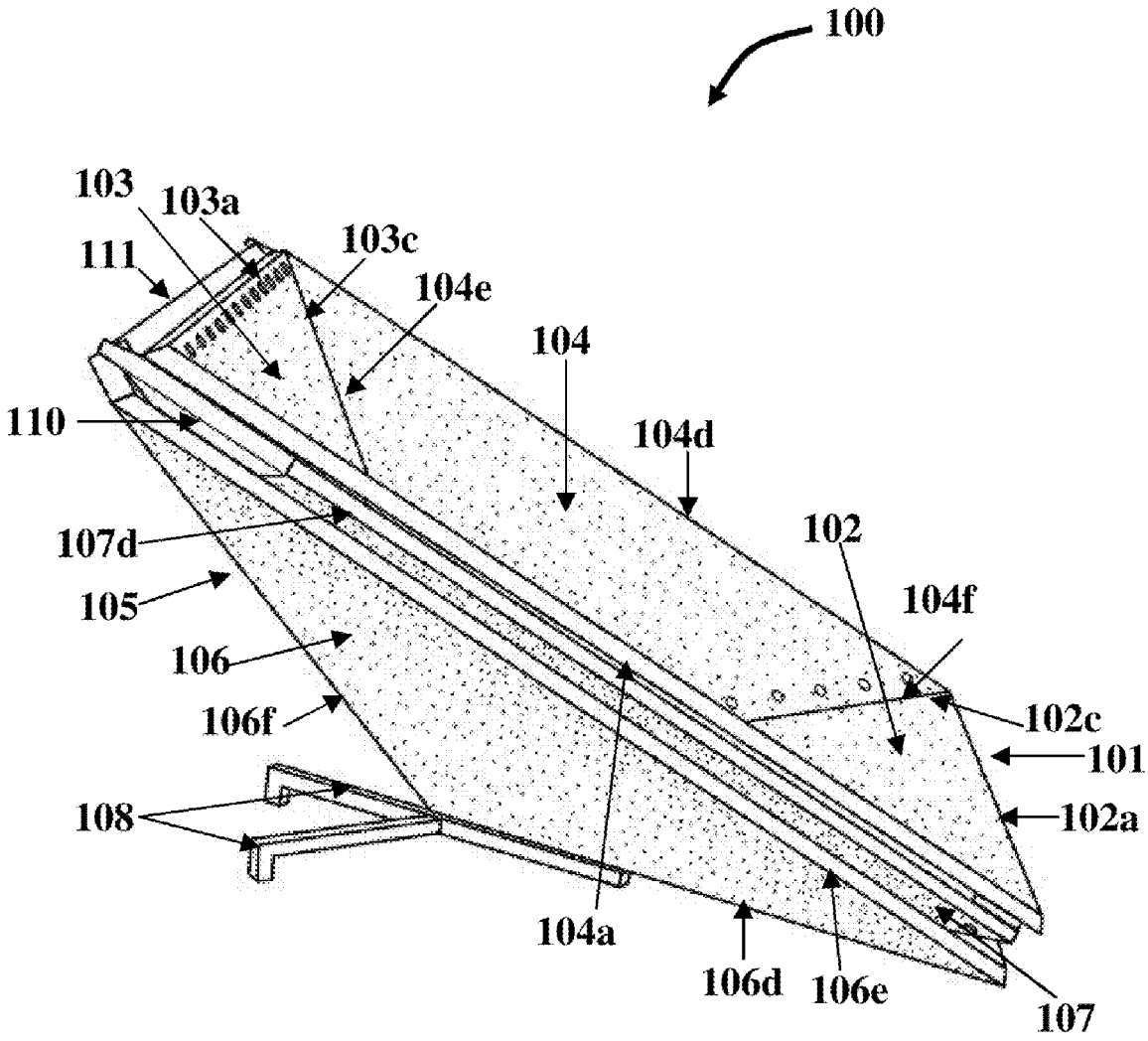
FIGS. 10A-10F exemplarily illustrate transformation of the collapsible seat from the folded arrangement to the unfolded arrangement.
Figure 10B:
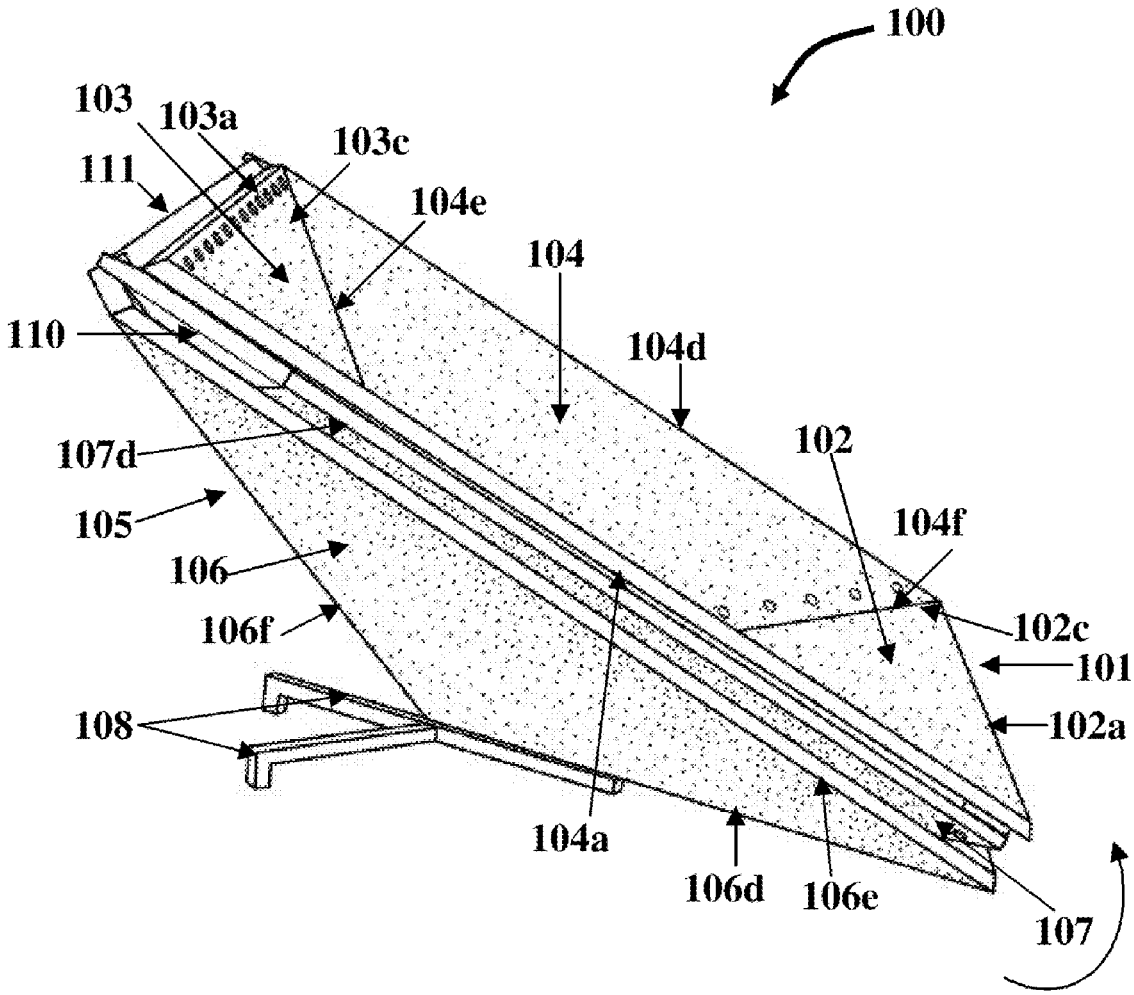
Figure 10C:
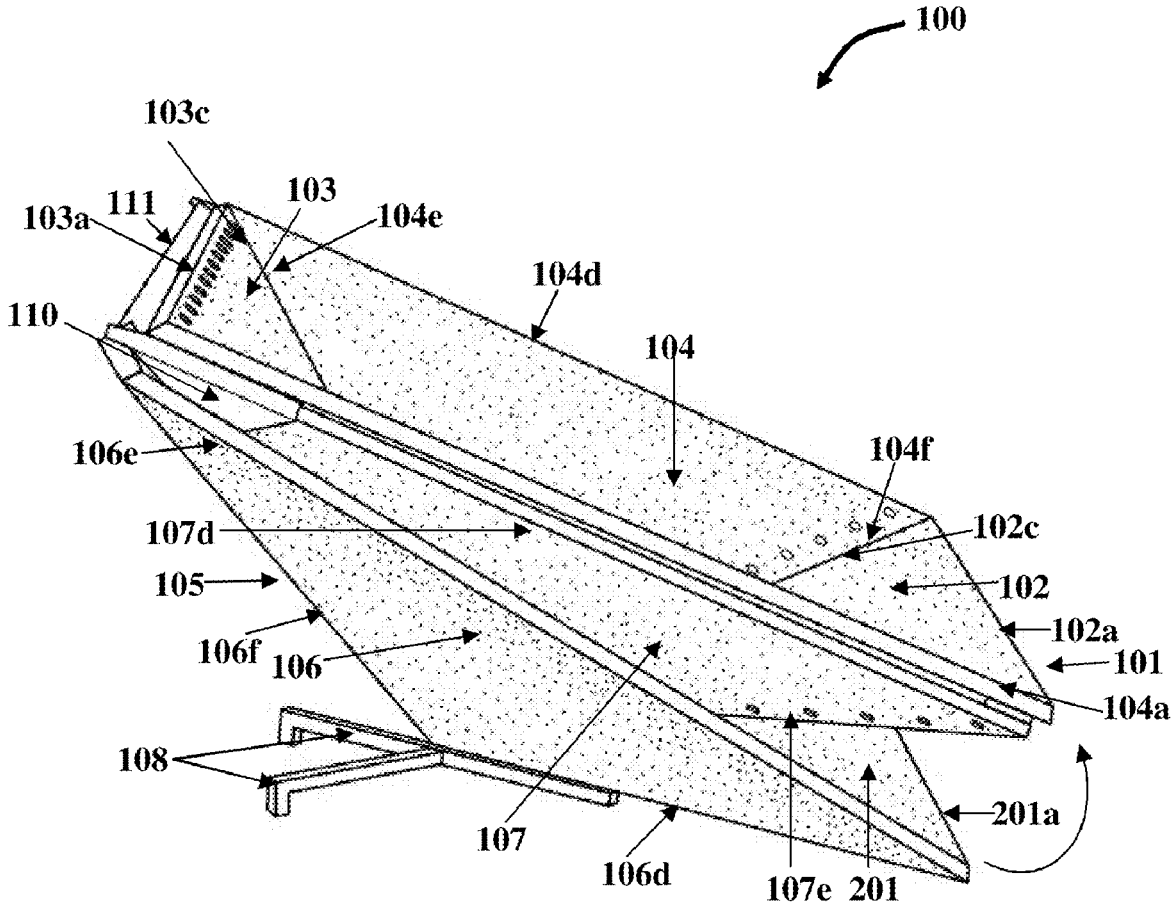
Figure 10D:
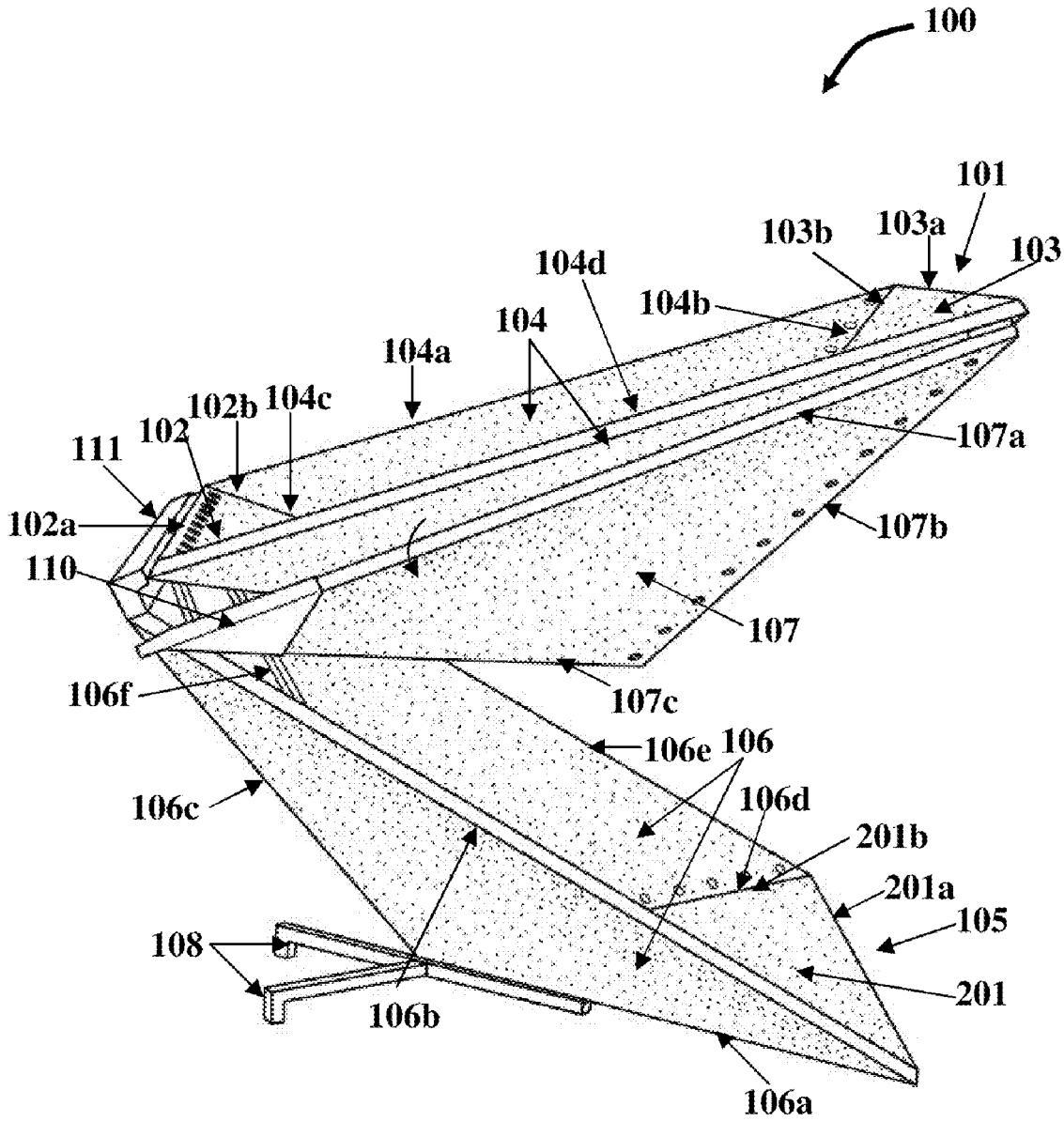

FIG. 9 illustrates a method of providing a seating area in an unfolded arrangement. A collapsible seat 100 in a folded arrangement is provided 901. The collapsible seat 100 in the folded arrangement is exemplarily illustrated in FIG. 10A. The collapsible seat 100 comprises a seating section 101, a base section 105 and a pair of collapsible legs 107 as explained in the detailed description of FIG. 1. The collapsible seat 100 in the folded arrangement comprises a seating section 101 and a pair collapsible legs 107 folded and accommodated within a base section 105 of the collapsible seat 100 as exemplarily illustrated in FIG. 10B. The seating section 101 is raised 902 by upwardly pivoting the seating section 101 from within the base section 105 as exemplarily illustrated in FIG. 10C and FIG. 10D. The seating section 101 is pivoted around endmost vertices defined by upper edges 106*b*, 106*c*, and 106*e*, 106*f* of the lateral supports 106. The upward pivoting of the seating section 101 may be performed using a metallic structure 111 attached between the endmost vertices defined by the upper edges 106*b*, 106*c*, and 106*e*, 106*f* of the lateral supports 106 and further attached to one of at least three edges, for example, edge 102*a* of the seat base 102 of the seating section 101.

Figure 10E:
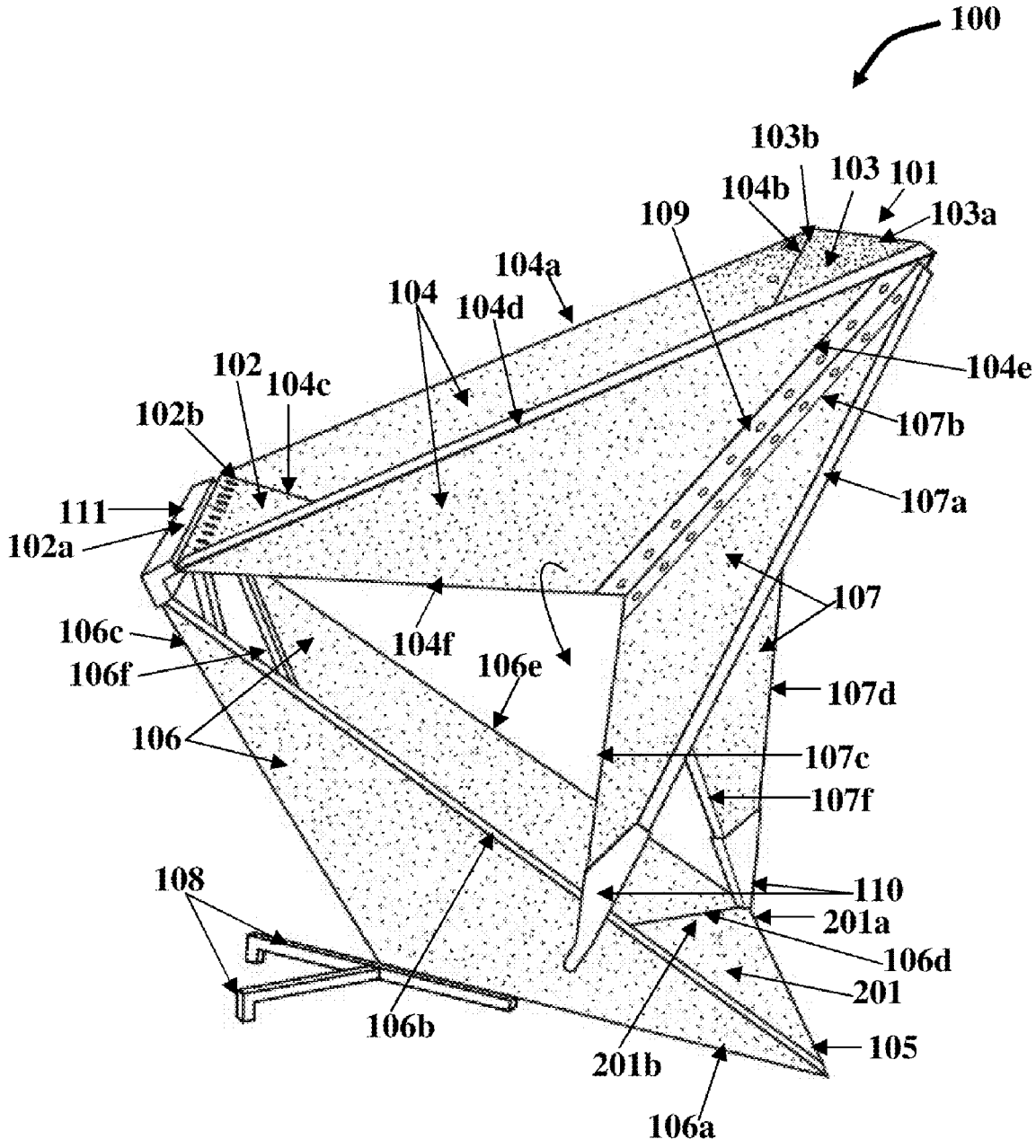
Figure 10F:
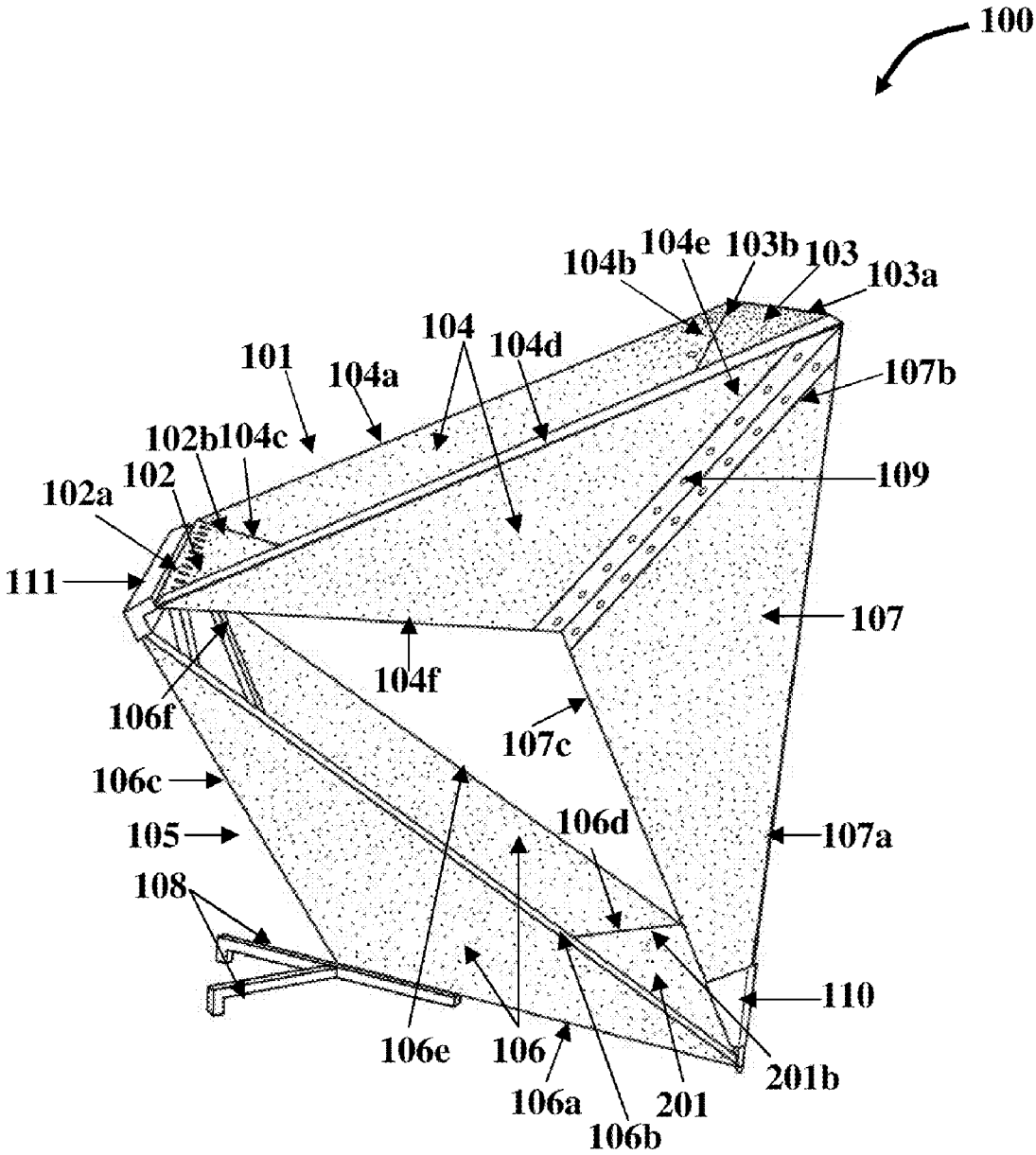
Figure 11:
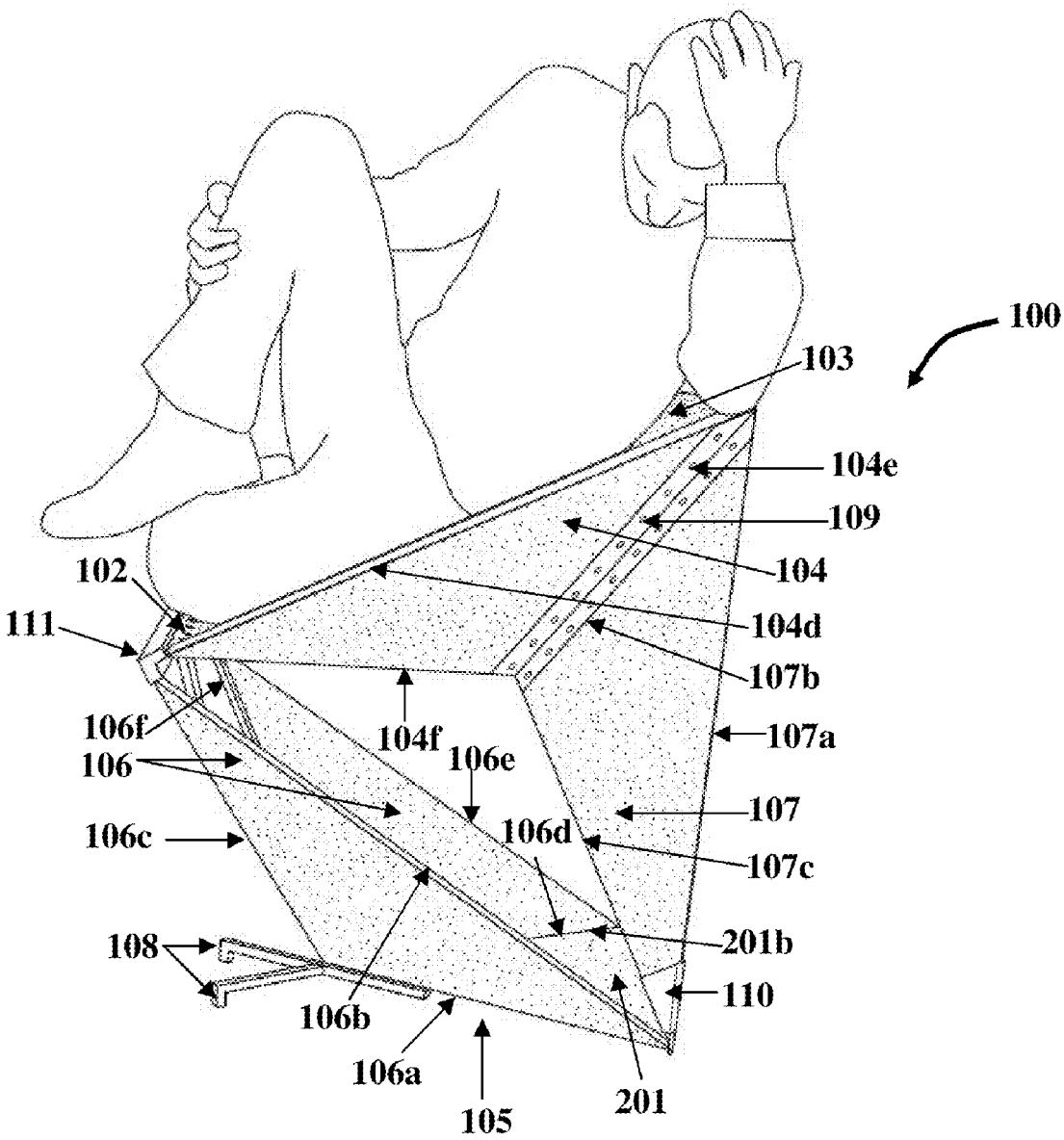
FIG. 11 exemplarily illustrates a person sitting on the collapsible seat in the unfolded arrangement.

The folded pair of collapsible legs 107 accommodated within the base section 105 is unfolded 903 by outwardly pivoting the folded pair of collapsible legs 107 around lateral edges 103*b* and 103*c* of the lumbar support 103 of the seating section 101 as exemplarily illustrated in FIG. 10E. The outward pivoting of the pair of collapsible legs 107 may be performed using a hinge 109 connected at each lateral edge 103*b* and 103*c* of the lumbar support 103 of the seating section 101 and at the upper edge 107*b* and 107*e* of each of the pair of collapsible legs 107 for enabling pivoting movement of the pair of collapsible legs 107. The unfolded pair of collapsible legs 107 is rested on a flat surface for supporting the seating section 101 thereby providing the seating area in the unfolded arrangement. The unfolded pair of collapsible legs 107 is supported on the flat surface by attaching multiple weight supports 110 to the bottom vertices of the unfolded pair of collapsible legs 107. The seating area in the unfolded arrangement is exemplarily illustrated in FIG. 10F. A person may sit on the collapsible seat 100 in the unfolded arrangement as exemplarily illustrated in FIG. 11.

Figure 12:
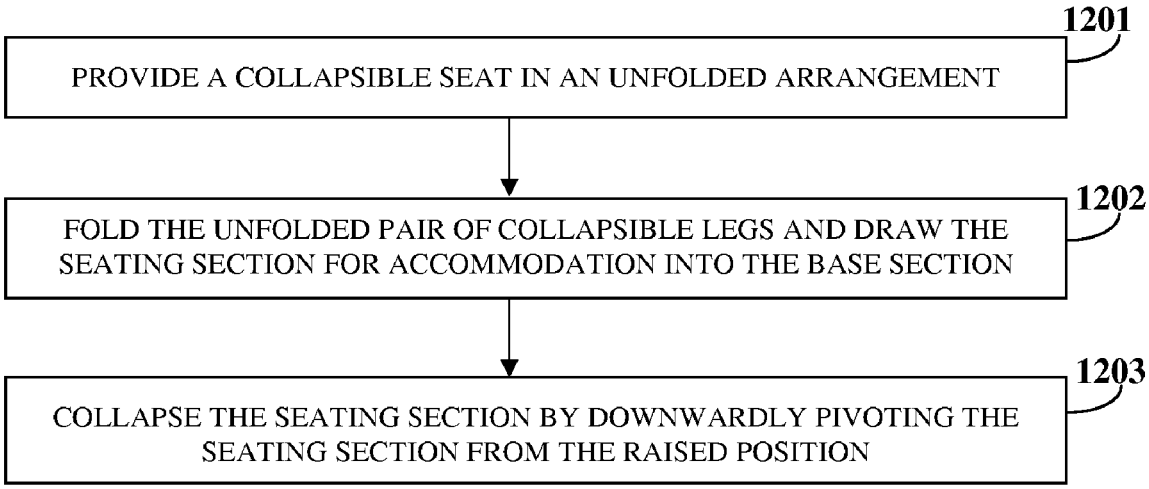
FIG. 12 illustrates a method of providing a seating area in a folded arrangement.
Figure 13A:
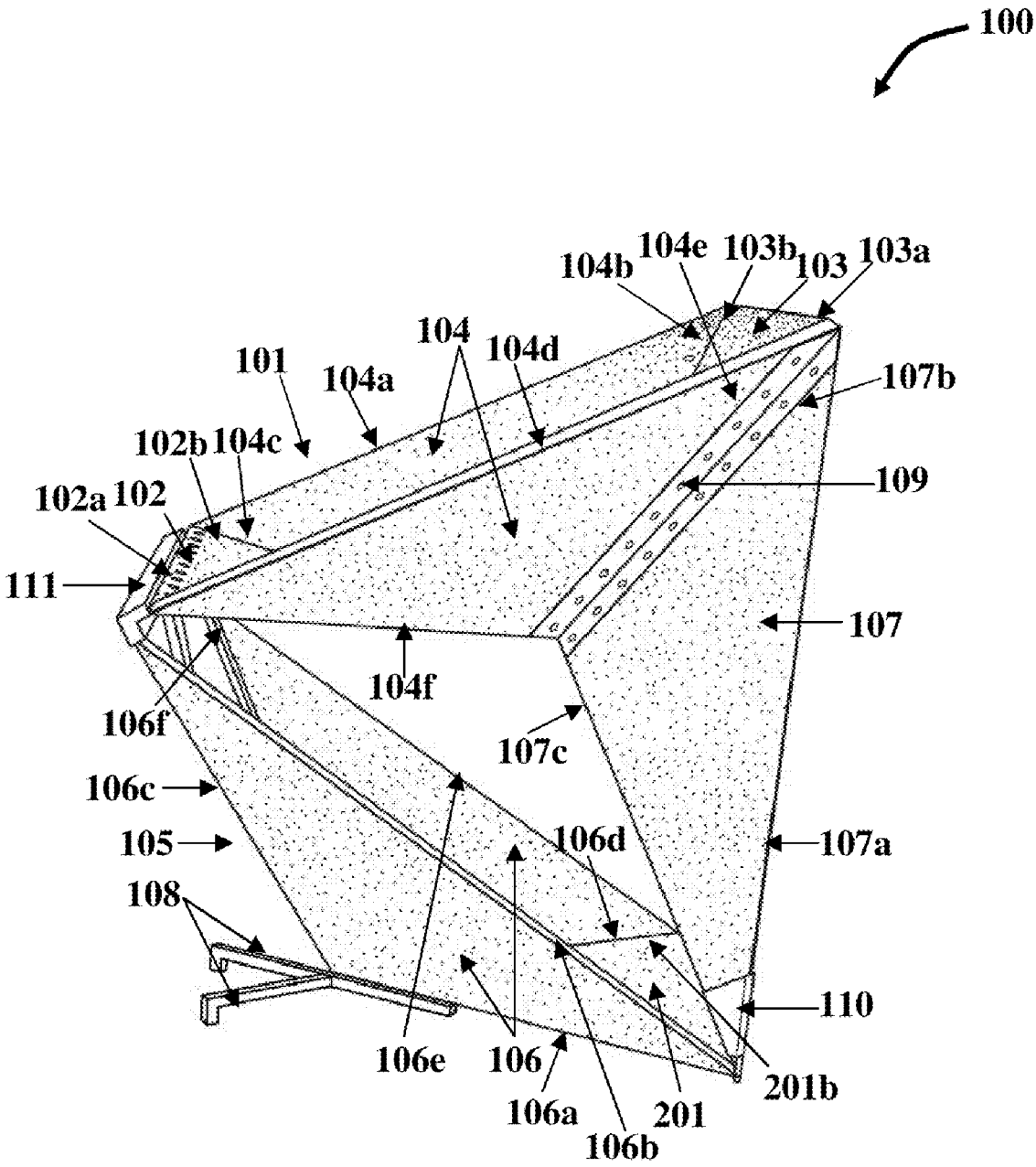
FIGS. 13A-13E exemplarily illustrate transformation of the collapsible seat from the unfolded arrangement to the folded arrangement.
Figure 13B:
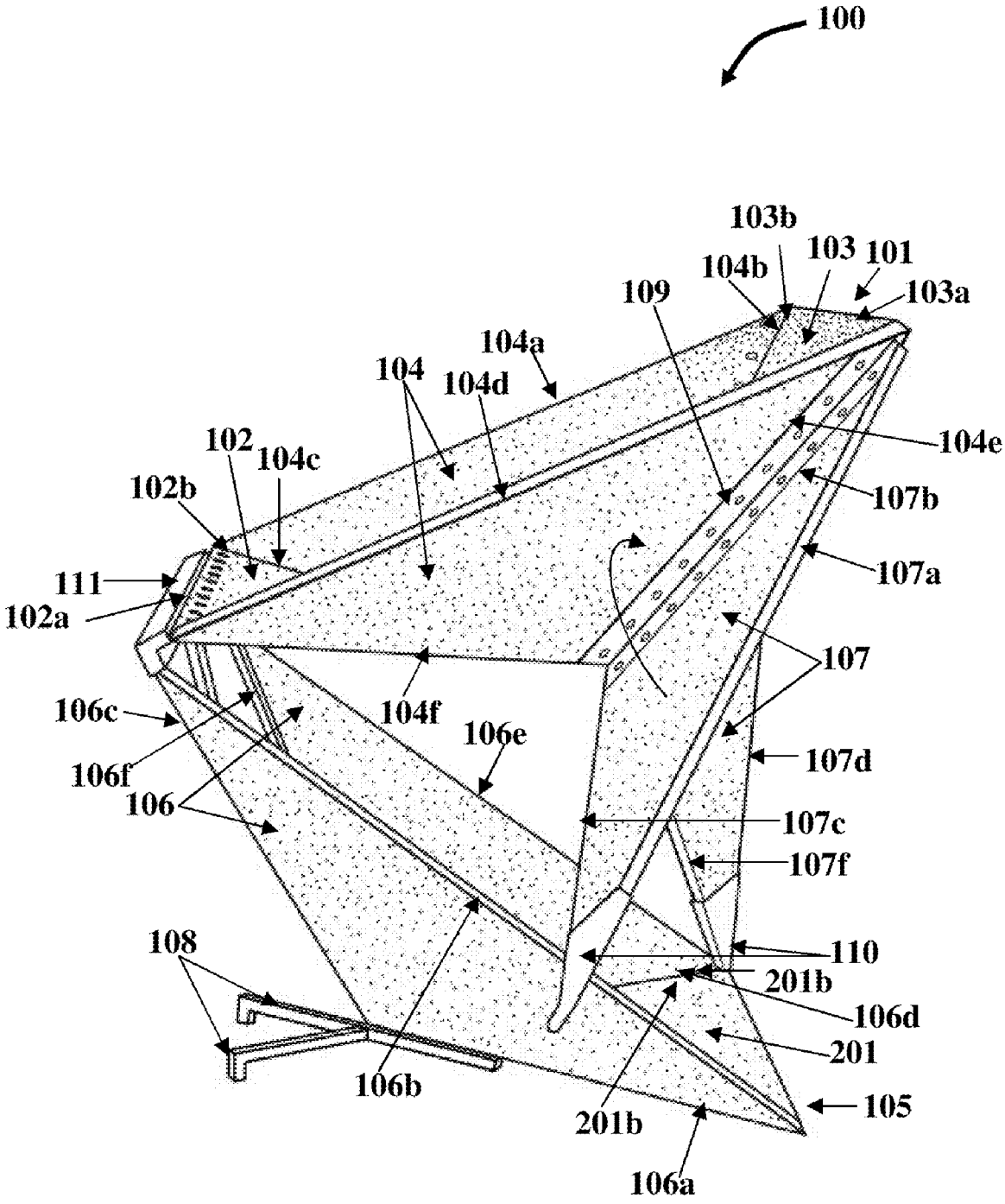
Figure 13C:
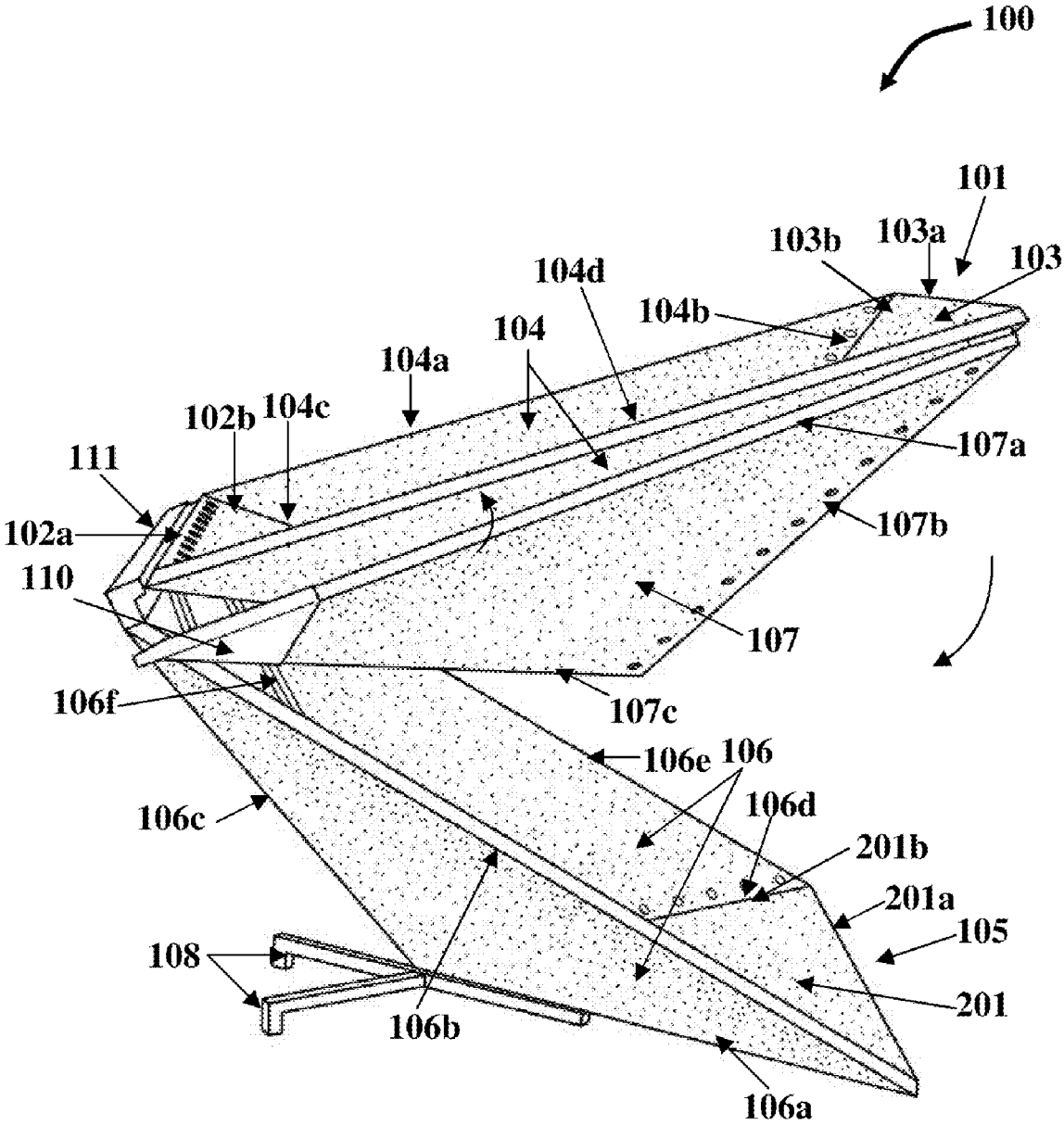
Figure 13D:
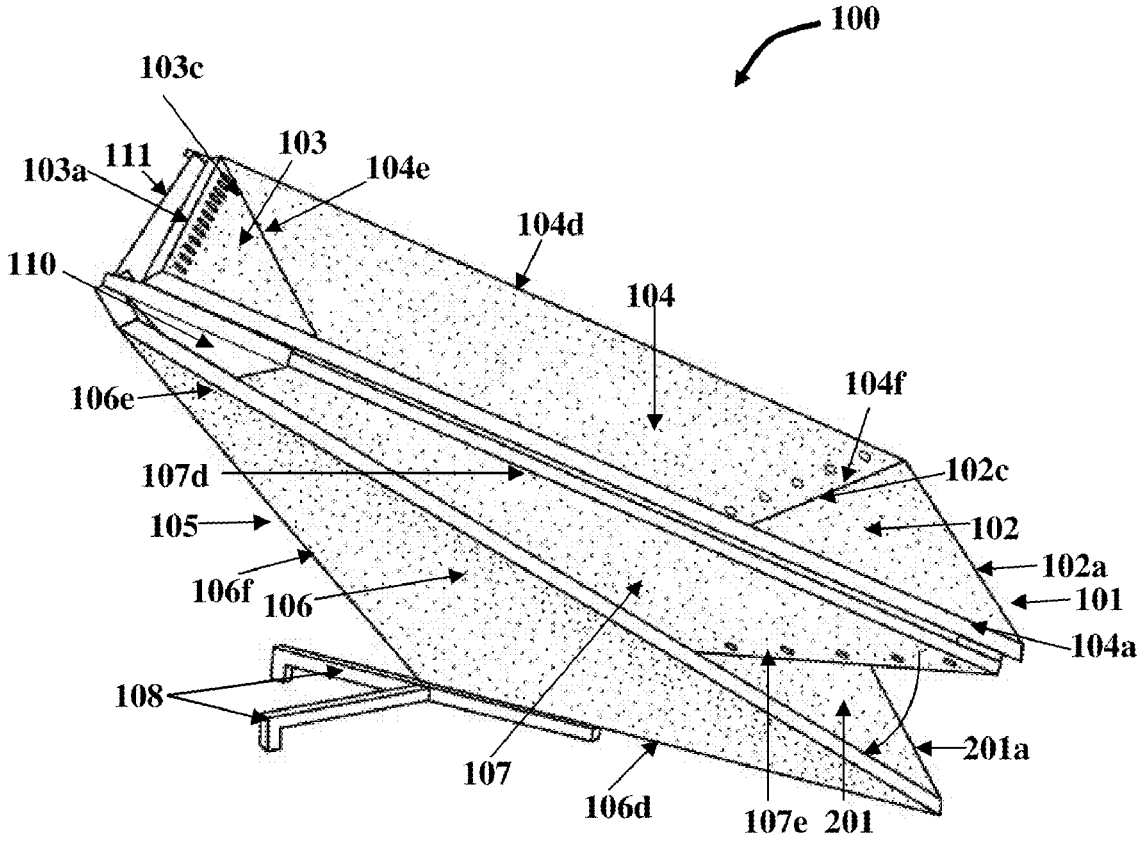

FIG. 12 illustrates a method of providing a seating area in a folded arrangement. A collapsible seat 100 in an unfolded arrangement is provided 1201. The collapsible seat 100 in an unfolded arrangement is exemplarily illustrated in FIG. 13A. The collapsible seat 100 comprises a seating section 101, a base section 105 and a pair of collapsible legs 107 as explained in the detailed description of FIG. 1. The seating section 101 of the collapsible seat 100 is in a raised position above a flat surface and supported by an unfolded pair of collapsible legs 107 of the collapsible seat 100. The unfolded pair of collapsible legs 107 is folded 1202 and the seating section 101 is drawn for accommodation into the base section 105 by inwardly pivoting the unfolded pair of collapsible legs 107 around lateral edges 103*b* and 103*c* of the lumbar support 103 of the seating section 101 as exemplarily illustrated in FIG. 13B. The inward pivoting for folding the pair of collapsible legs 107 may be performed using a hinge 109 connected at each lateral edge 103*b* and 103*c* of the lumbar support 103 of the seating section 101 and at the upper edge 107*b* and 107*e* of each of the pair of collapsible legs 107. The folded pair of collapsible legs 107 is further accommodated into the base section 105 as exemplarily illustrated in FIG. 13C and FIG. 13D.

Figure 13E:
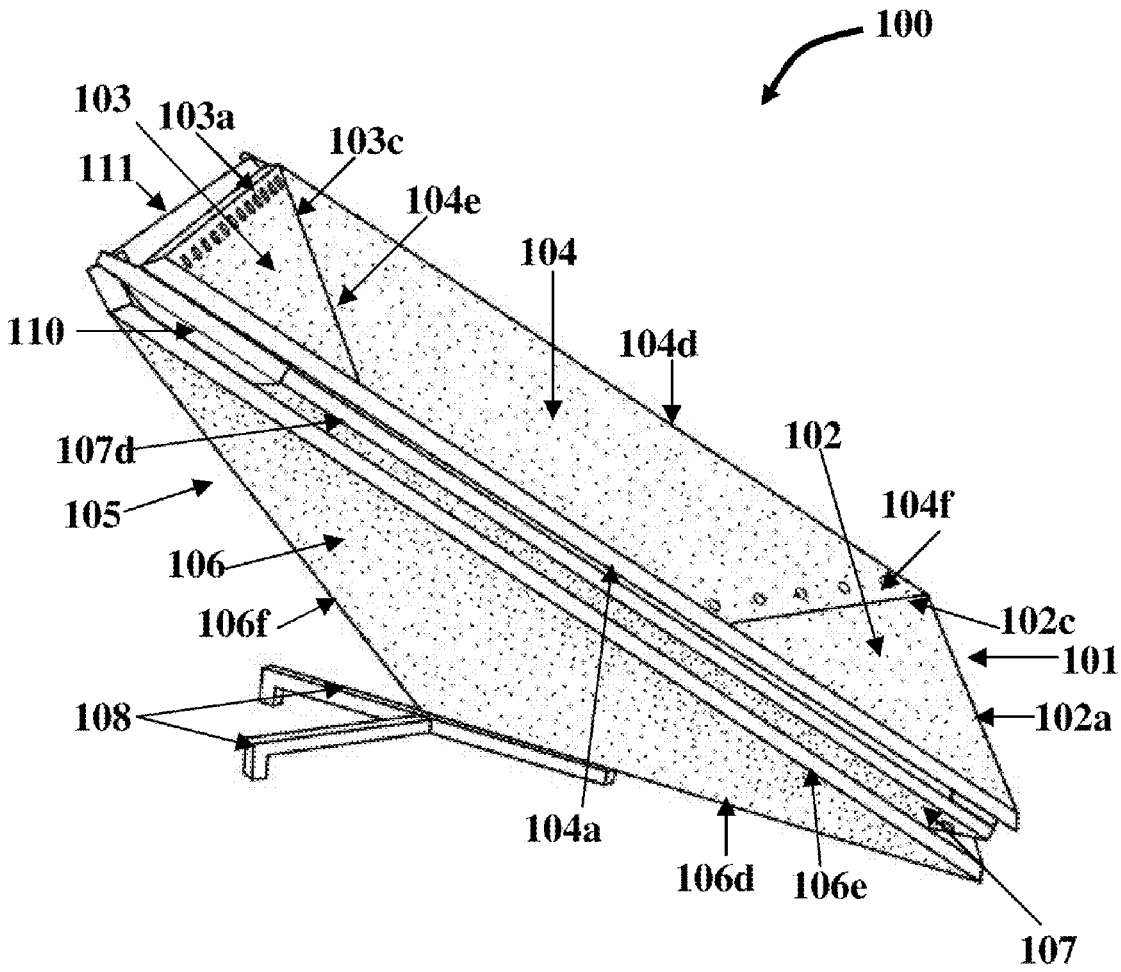

The seating section 101 is collapsed 1203 by downwardly pivoting the seating section 101 from the raised position. The downward pivoting for collapsing the seating section 101 may be performed using a metallic structure 111 attached between the endmost vertices of the upper edges 106*b*, 106*c*, and 106*e*, 106*f* of the lateral supports 106 and further attached to one of at least three edges, for example, edge 102*a* of the seat base 102. The seating section 101 is pivoted around endmost vertices of the upper edges 106*b*, 106*c*, and 106*e*, 106*f* of the pair of lateral supports 106 and accommodated into the base section 105 thereby providing the seating area in the folded arrangement as exemplarily illustrated in FIG. 13E. The lumbar support 103 in the unfolded arrangement illustrated in FIGS. 13A-13C now becomes the seat base 102 in the folded arrangement illustrated in FIGS. 13D-13E and vice versa.

Consider, for example, a person John at a park. The park has no benches or chairs to rest. John carries the collapsible seat 100 comprising a triangular seating section 101, a triangular base section 105, and a pair of triangular collapsible legs 107 defined by triangular shaped planar sections 102, 103, and 107, 106 and 201, and 107 to the park in a folded arrangement and chooses a suitable area in the park to place the collapsible seat 100. John first positions the triangular resting base 201 of the triangular base section 105 of the collapsible seat 100 on the ground. John then lifts the triangular seating section 101 of the collapsible seat 100 from the triangular base section 105 and unfolds the folded pair of triangular collapsible legs 107. John then places the folded pair of triangular collapsible legs 107 on the ground for supporting the triangular lumbar support 103 of the triangular seating section 101. John sits on the triangular seat base 102 of the triangular seating section 101 and uses the triangular lumbar support 103 for resting his back and uses the triangular arm rests 104 for resting his arms.

If John wants to change his posture and the position of the collapsible seat 100 after a certain amount of time, he folds the pair of triangular collapsible legs 107 and moves the triangular seating section 101 back into the triangular base section 105 of the collapsible seat 100. John now sits on the triangular seat base 102 of the triangular seating section 101 accommodated within the triangular base section 105 in the folded arrangement of the collapsible seat 100.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A collapsible seat, comprising:

a seating section comprising a seat base, a lumbar support, and a pair of arm rests, wherein each of said seat base, said lumbar support, and said pair of arm rests is defined by a one of a plurality of first planar sections, wherein each of said first planar sections is a polygon of a substantially similar shape and size to each other of the first planar sections, wherein each of the first planar sections defines at least three edges on a periphery of said each of the first planar sections, wherein at least two of said edges of each of the first planar sections define a first vertex, wherein a one of said edges of each of the first planar sections is attached to a one of said edges of an adjacent one of the first planar sections, and wherein said first vertex of each of the first planar sections lies at a first convergence point common to said plurality of first planar sections;

a base section pivotally connected to a one of said at least three edges of the seat base of said seating section, wherein said base section comprises a pair of lateral supports and a resting base, wherein each of said pair of lateral supports and said resting base is defined by a one of a plurality of second planar sections for supporting the seating section, wherein each of said second planar sections is a polygon of a substantially similar shape and size to each other of the second planar sections, wherein each of the second planar sections defines at least three edges on a periphery of said each of the second planar sections, wherein at least two of said edges of each of the second planar sections define a second vertex, wherein a one of said edges of each of the second planar sections is attached to a one of said edges of an adjacent one of the second planar sections, and wherein said second vertex of each of the second planar sections lies at a second convergence point common to said plurality of second planar sections; and a pair of collapsible legs, wherein each of said pair of collapsible legs is defined by a one of a pair of third planar sections, wherein each of said pair of third planar sections is a polygon of a substantially similar shape and size to each other of a said third planar sections, wherein each of the third planar sections defines at least three edges on a periphery of said each of the third planar sections, wherein a one of said edges of each of the pair of third planar sections is pivotally connected to a one of said edges of the lumbar support of the seating section for further supporting the seating section.

2. The collapsible seat of claim 1, wherein said polygon is a triangle, and wherein each of the first planar sections, the second planar sections and the third planar sections is of substantially similar shape and size to each other of the first planar sections, the second planar sections, and the third planar sections, and wherein the seating section and the base section define a four-sided pyramid.

3. The collapsible seat of claim 1, wherein the base section further comprises a metallic structure attached between endmost vertices defined by upper edges of said pair of lateral supports and further attached to said one of said at least three edges of the seat base of the seating section for enabling pivoting movement of the seating section.

4. The collapsible seat of claim 1, further comprising a hinge at each lateral edge of the lumbar support of the seating section and at upper edge of each of said pair of collapsible legs, wherein said hinge enables pivoting movement of the pair of collapsible legs.

5. The collapsible seat of claim 1, further comprising a support structure detachably attached to the base section at said second convergence point for supporting the base section on a flat surface.

6. The collapsible seat of claim 1, wherein said pair of collapsible legs comprises a plurality of weight supports attached to bottom vertices of said pair of third planar sections, wherein said weight supports rest on a flat surface for supporting position of the seating section and bearing weight of the seating section.

7. A method of providing a seating area in an unfolded arrangement, comprising the steps of:

providing a collapsible seat in a folded arrangement, wherein a seating section and a pair of collapsible legs of said collapsible seat are folded and accommodated within a base section of the collapsible seat in said folded arrangement, and wherein the collapsible seat comprises:

said seating section comprising a seat base, a lumbar support, and a pair of arm rests, wherein each of said seat base, said lumbar support, and said pair of arm rests is defined by a one of a plurality of first planar sections, wherein each of said first planar sections is a polygon of a substantially similar shape and size to each other of the first planar sections, wherein each of the first planar sections defines at least three edges on a periphery of said each of the first planar sections, wherein at least two of said edges of each of the first planar sections define a first vertex, wherein a one of said edges of each of the first planar sections is attached to a one of said edges of an adjacent one of the first planar sections, and wherein said first vertex of each of the first planar sections lies at a first convergence point common to said plurality of first planar sections;

said base section pivotally connected to a one of said at least three edges of the seat base of said seating section, wherein said base section comprises a pair of lateral supports and a resting base, wherein each of said pair of lateral supports and said resting base is defined by a one of a plurality of second planar sections for supporting the seating section, wherein each of said second planar sections is a polygon of a substantially similar shape and size to each other of the second planar sections, wherein each of the second planar sections defines at least three edges on a periphery of said each of the second planar sections, wherein at least two of said edges of each of the second planar sections define a second vertex, wherein a one of said edges of each of the second planar sections is attached to a one of said edges of an adjacent one of the second planar sections, and wherein said second vertex of each of the second planar sections lies at a second convergence point common to said plurality of second planar sections; and said pair of collapsible legs, wherein each of said pair of collapsible legs is defined by a one of a pair of third planar sections, wherein each of said pair of third planar sections is a polygon of a substantially similar shape and size to each other of said third planar sections, wherein each of the third planar sections defines at least three edges on a periphery of said each of the third planar sections, wherein a one of said edges of each of the pair of third planar sections is pivotally connected to a one of said edges of the lumbar support of the seating section for further supporting the seating section;

raising the seating section by upwardly pivoting the seating section from within the base section, wherein the seating section is pivoted around endmost vertices defined by upper edges of said lateral supports; and unfolding said folded pair of collapsible legs accommodated within the base section by outwardly pivoting the folded pair of collapsible legs around lateral edges of said lumbar support of the seating section, wherein said unfolded pair of collapsible legs is rested on a flat surface for supporting the seating section;

whereby said seating area in said unfolded arrangement is provided.

8. The method of claim 7, wherein said step of raising the seating section by upward pivoting is performed using a metallic structure attached between said endmost vertices of said upper edges of the lateral supports and further attached to said one of said at least three edges of the seat base of the seating section.

9. The method of claim 7, wherein said step of unfolding the pair of collapsible legs by outward pivoting is performed using a hinge connected at each lateral edge of the lumbar support of the seating section and at upper edge of each of the pair of collapsible legs for enabling pivoting movement of the pair of collapsible legs.

10. The method of claim 7, wherein the unfolded pair of collapsible legs is supported on said flat surface by attaching a plurality of weight supports to bottom vertices of the pair of collapsible legs.

11. A method of providing a seating area in an folded arrangement, comprising the steps of:

providing a collapsible seat in an unfolded arrangement, wherein a seating section of said collapsible seat is in a raised position above a flat surface and supported by an unfolded pair of collapsible legs of the collapsible seat, and wherein the collapsible seat comprises:

said seating section comprising a seat base, a lumbar support, and a pair of arm rests, wherein each of said seat base, said lumbar support, and said pair of arm rests is defined by a one of a plurality of first planar sections, wherein each of said first planar sections is a polygon of a substantially similar shape and size to each other of the first planar sections, wherein each of the first planar sections defines at least three edges on a periphery of said each of the first planar sections, wherein at least two of said edges of each of the first planar sections define a first vertex, wherein a one of said edges of each of the first planar sections is attached to a one of said edges of an adjacent one of the first planar sections, and wherein said first vertex of each of the first planar sections lies at a first convergence point common to said plurality of first planar sections;

a base section pivotally connected to a one of said at least three edges of the seat base of said seating section, wherein said base section comprises a pair of lateral supports and a resting base, wherein each of said pair of lateral supports and said resting base is defined by a one of a plurality of second planar sections for supporting the seating section, wherein each of said second planar sections is a polygon of a substantially similar shape and size to each other of the second planar sections, wherein each of the second planar sections defines at least three edges on a periphery of each of the second planar sections, wherein at least two of said edges of each of second planar sections define a second vertex, wherein a one of said edges of each of the second planar sections is attached to a one of said edges of an adjacent one of the second planar sections, and wherein said second vertex of each of the second planar sections lies at a second convergence point common to said plurality of second planar sections; and a pair of collapsible legs, wherein each of said pair of collapsible legs is defined by a one of a pair of third planar sections, wherein each of said pair of third planar sections is a polygon of a substantially similar shape and size to each other of the third planar sections, wherein each of the third planar sections defines at least three edges on a periphery of each of the third planar sections, wherein a one of said edges of each of the third planar sections is pivotally connected to a one of said edges of the lumbar support of the seating section for further supporting the seating section;

folding said unfolded pair of collapsible legs and drawing the seating section for accommodation into the base section by inwardly pivoting the unfolded pair of collapsible legs around lateral edges of said lumbar support of the seating section, wherein said folded pair of collapsible legs is further accommodated into the base section; and collapsing the seating section by downwardly pivoting the seating section from said raised position, wherein the seating section is pivoted around endmost vertices of upper edges of said pair of lateral supports and accommodated into the base section;

whereby said seating area in said folded arrangement is provided.

12. The method of claim 11, wherein said step of downward pivoting for collapsing the seating section is performed using a metallic structure attached between endmost vertices of upper edges of the lateral supports and further attached to said one of said at least three edges of the seat base of the seating section.

13. The method of claim 11, wherein said step of inward pivoting for folding the pair of collapsible legs is performed using a hinge connected at each lateral edge of the lumbar support of the seating section and at an upper edge of each of the pair of collapsible legs.

* * * * *